US006776584B2

(12) United States Patent
Sabini et al.

(10) Patent No.: US 6,776,584 B2
(45) Date of Patent: Aug. 17, 2004

(54) METHOD FOR DETERMINING A CENTRIFUGAL PUMP OPERATING STATE WITHOUT USING TRADITIONAL MEASUREMENT SENSORS

(75) Inventors: Eugene P. Sabini, Skaneateles, NY (US); Jerome A. Lorenc, Seneca Falls, NY (US); Barry Erickson, Fairport, NY (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 124 days.

(21) Appl. No.: 10/042,877

(22) Filed: Jan. 9, 2002

(65) Prior Publication Data

US 2003/0129062 A1 Jul. 10, 2003

(51) Int. Cl.[7] ..... F04B 49/00

(52) U.S. Cl. ..... 417/22; 417/42; 417/63; 415/1; 415/13; 415/17; 73/168; 702/113

(58) Field of Search ..... 417/22, 42, 53, 417/63, 423.1; 415/1, 17, 13–50, 118; 73/168; 702/113, 114

(56) References Cited

U.S. PATENT DOCUMENTS 6,260,004 B1 * 7/2001 Hays et al. ..... 702/183
6,464,464 B2 * 10/2002 Sabini et al. ..... 417/19
2002/0018721 A1 * 2/2002 Kobayashi et al. ..... 417/44.1
2002/0176783 A1 * 11/2002 Moeller ..... 417/44.11

* cited by examiner

*Primary Examiner*—Cheryl J. Tyler
*Assistant Examiner*—John F Belena

(57) ABSTRACT

A method for determining whether a centrifugal pump is operating within its normal flow operating range includes the steps: of determining a motor torque/TDH relationship over a range of speeds for a minimum flow rate in order to obtain a minimum flow operating range for the centrifugal pump; determining a motor torque/TDH relationship over a range of speeds for a maximum flow rate in order to obtain a maximum flow operating range for the centrifugal pump; determining the actual operating motor torque and TDH of the centrifugal pump at a given operating point; and determining whether the actual operating motor torque and TDH of the centrifugal pump fall within the minimum flow and maximum flow operating ranges of the centrifugal pump.

17 Claims, 2 Drawing Sheets

METHOD FOR DETERMINING A CENTRIFUGAL PUMP OPERATING STATE WITHOUT USING TRADITIONAL MEASUREMENT SENSORS

FIELD OF THE INVENTION

This invention relates generally to centrifugal pumps, and, more particularly, to an improved method and apparatus for determining the operating point of a centrifugal pump.

BACKGROUND OF THE INVENTION

As is known, a centrifugal pump has a wheel fitted with vanes and known as an impeller. The impeller imparts motion to the fluid which is directed through the pump. A centrifugal pump provides a relatively steady fluid flow. The pressure for achieving the required head is produced by centrifugal acceleration of the fluid in the rotating impeller. The fluid flows axially towards the impeller, is deflected by it and flows out through apertures between the vanes. Thus, the fluid undergoes a change in direction and is accelerated. This produces an increase in the pressure at the pump outlet. When leaving the impeller, the fluid may first pass through a ring of fixed vanes which surround the impeller and is commonly referred to as a diffuser. In this device, with gradually widening passages, the velocity of the liquid is reduced, its kinetic energy being converted into pressure energy. Of course it is noted that in some centrifugal pumps there is no diffuser and the fluid passes directly from the impeller to the volute. The volute is a gradual widening of the spiral casing of the pump. Centrifugal pumps are well known and are widely used in many different environments and applications.

The prior art also refers to centrifugal pumps as velocity machines because the pumping action requires first, the production of the liquid velocity; second, the conversion of the velocity head to a pressure head. The velocity is given by the rotating impeller, the conversion accomplished by diffusing guide vanes in the turbine type and in the volute case surrounding the impeller in the volute type pump. With a few exceptions, all single state pumps are normally of the volute type. Specific speed $N_s$ of the centrifugal pump is $NQ^{1/2}/H^{3/4}$. Ordinarily, N is expressed in rotations per minute, Q in gallons per minute and head (H) in feet. The specific speed of an impeller is an index to its type. Impellers for high heads usually have low specific speeds, while those for low heads have high specific speeds. The specific speed is a valuable index in determining the maximum suction head that may be employed without the danger of cavitation or vibration, both of which adversely effect capacity and efficiency. Operating points of centrifugal pumps are extremely important.

Several common methods are employed in the prior art to determine the actual operating point of a centrifugal pump. Each of these methods is based on the basic premise that any two independent pump variables accurately measured will determine the operating point of a centrifugal pump. The operating point of a pump is commonly thought of as the flow rate and Total Dynamic Head (TDH) that the pump is delivering. The flow rate is sometimes referred to as a percentage of the Best Efficiency Point flow of that pump.

One method used to determine the operating point of a centrifugal pump is to physically measure the flow rate and TDH of the pump. Sensors are used to measure the pressure generated across the pump, flow, speed and temperature. The pressure generated across the pump can be measured using two transducers (one for suction pressure and one for discharge pressure) or one transducer (differential pressure transmitter across the pump). Speed and temperature measurements are required to make speed and specific gravity corrections to the pressure to calculate the TDH. Flow rate is the other principle measurement needed to plot TDH vs. flow. Flow rate can be measured using a variety of sensors from orifice plates to magnetic flow meters.

Another commonly employed method is to calculate the fixed speed motor's electrical power. The two independent pump variables are Brake Horsepower (BHP) and speed. One way to calculate the electrical power is to measure the electrical current and calculate the kilowatt input to the motor. Once the kilowatt input is known the BHP output of the motor is calculated using motor efficiency data. Based on the hydraulic pump performance either typical for that model pump or the actual test data, for the actual speed of the pump, the operating point of the pump is determined from the intersection of the calculated BHP to the pump and the impeller diameter. This method requires only one sensor, an electrical current probe.

A similar but more accurate approach is to measure the total kilowatt input to the motor. This requires the measurement of two electrical currents and two voltages along with a kilowatt transmitter. This method will automatically correct for power factor. Again once the kilowatt input is known the BHP output of the motor is calculated based on motor efficiency. Referring to the hydraulic pump performance curve for the operating speed of the pump, the operating point can be determined.

Of the foregoing approaches, the first approach, namely, physically measuring the flow rate and TDH of the pump, is the most accurate means of determining the operating point of the pump, assuming proper use of instrumentation. However, this approach requires the purchase and installation of instruments to measure, suction pressure, discharge pressure, pumpage temperature, flow, and speed. Initial cost, installation and upkeep of all the sensors may not be justifiable.

The method of calculating the fixed speed motor's electrical power also has several drawbacks. First, the electrical power factor is unknown and assumed to be 1.0. This is often not the case in actual plant installations. Second, actual pump performance may differ from the typical hydraulic data available for that model pump. Or, if the pump was actually tested, its performance in the plant may be different due to pumpage specific gravity or viscosity changes.

Measuring total kilowatt input into the motor eliminates one of the drawbacks of the previous method. That is, it eliminates the need to determine the electrical power factor to the motor. There still exists, however, error due to the discrepancy between the pump's actual performance vis a vis typical or actual tested pump performance at the factory, due to specific gravity or viscosity changes.

A further drawback of the two latter methods is that the BHP curve on many centrifugal pumps varies little with changes in flow. A small error in BHP calculations will result in a large change in the operating point of the pump.

Improved methods for determining the actual operating point of a centrifugal pump are therefore desirable.

SUMMARY OF THE INVENTION

The invention provides a method and apparatus for determining the operating point of a centrifugal pump based on motor torque and motor speed. The method provides a way for determining whether the pump is operating within its normal flow operating range while eliminating the need for pump sensors employed using conventional methods.

According to one aspect of the invention, a method for determining whether a centrifugal pump is operating in a normal flow operating range is provided and includes the steps of: determining a motor torque/TDH relationship over a range of speeds for a minimum flow rate in order to obtain a minimum flow operating range for the centrifugal pump; determining a motor torque/TDH relationship over a range of speeds for a maximum flow rate in order to obtain a maximum flow operating range for the centrifugal pump; determining the actual operating motor torque and TDH of the centrifugal pump at a given operating point; and determining whether the actual operating motor torque and TDH of the centrifugal pump falls within the minimum flow and maximum flow operating ranges of the centrifugal pump.

BRIEF DESCRIPTION OF THE DRAWINGS

Other aspects, advantages and novel features of the invention will become more apparent from the following detailed description of the invention when considered in conjunction with the accompanying drawings wherein.

DETAILED DESCRIPTION

Figure 1:
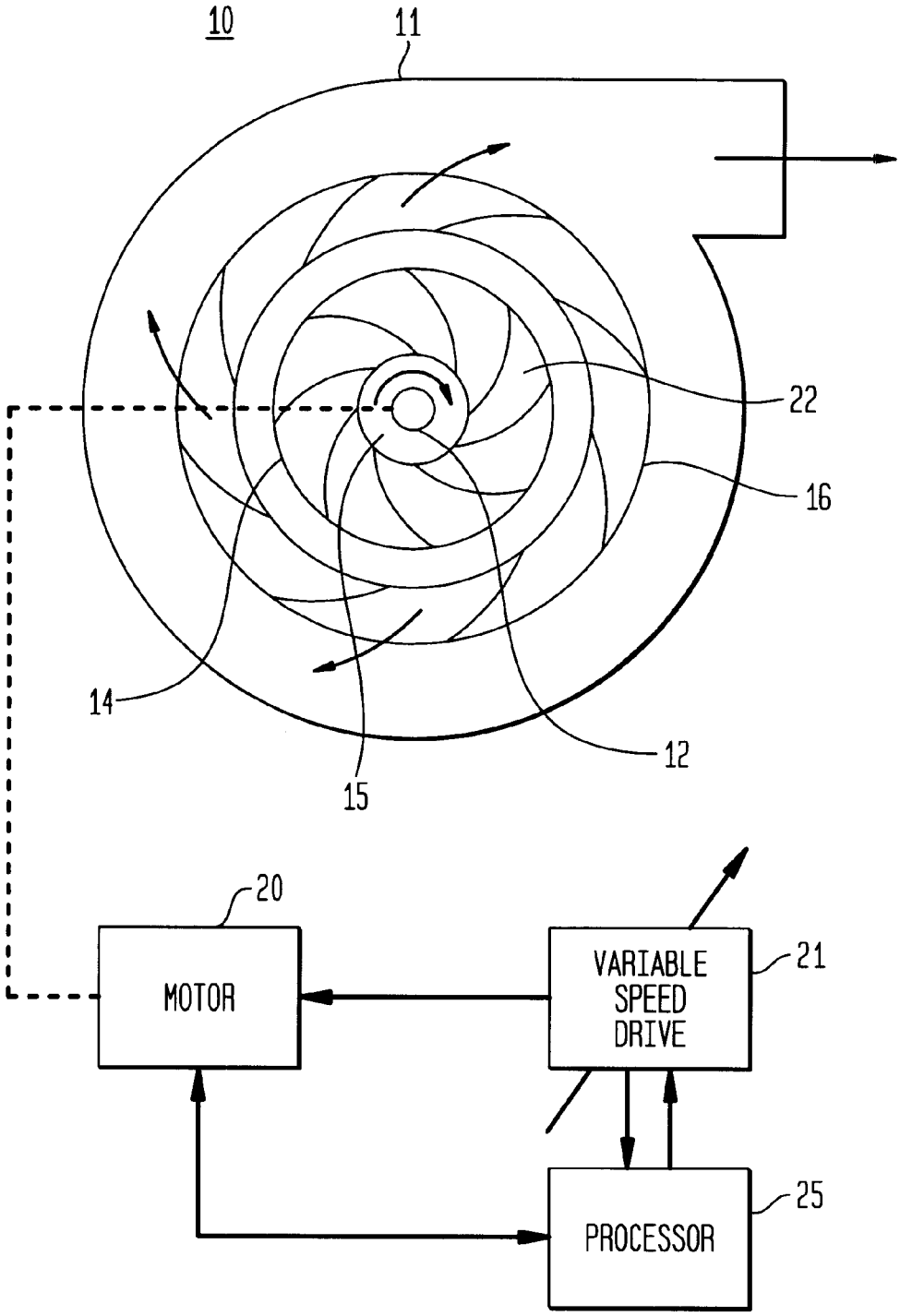
FIG. 1 is a schematic depicting a centrifugal pump driven by a motor having a variable speed drive according to an aspect of this invention.

Referring to FIG. 1, there is shown a schematic view of a typical centrifugal pump 10. The centrifugal pump 10 has a housing 11 which contains a central drive shaft 12. The drive shaft 12 is coupled to and spaced from an impeller member 14. There is a space 15 between the drive shaft 12 and the impeller 14 which allows for the inlet of a fluid or substance to be pumped. The fluid can be water or any other suitable material. As indicated, a centrifugal pump may include a diffuser 16. The diffuser is not necessary and is shown by way of example. As can be seen, the impeller 14 includes a series of blades or vanes and is rotated by means of the drive shaft 12. The drive shaft 12, as seen, is mechanically coupled to a motor 20 which in turn is driven in this particular invention by a variable speed drive apparatus 21.

Essentially, the arrows show the flow of fluid through the centrifugal pump. The centrifugal pump provides a relatively steady flow. The pressure for achieving the required delivery head is produced by centrifugal acceleration of the fluid in the rotating impeller 14. The fluid flows axially towards the impeller, is deflected by the impeller and is discharged through the apertures or spacings 22 between the vanes of the impeller 14. Thus, the fluid experiences a change in direction and is therefore accelerated which produces an increase in pressure at the pump outlet. When the fluid leaves the impeller, the fluid passes through a ring of fixed vanes which surround the impeller and, as indicated, is referred to as a diffuser 16. A diffuser 16 has gradually widening passages where the velocity of the liquid being pumped is reduced. Basically, the diffuser, as indicated, works so that kinetic energy is converted into pressure. This conversion is completed by the volute of the pump which is the gradual widening of the spiral casing. As indicated, some pumps have no diffuser and the fluid passes directly from the impeller to the volute.

In any event, as seen, the centrifugal pump is operated by means of a motor. The output shaft of the motor is coupled to the drive shaft 12. The motor is capable of variable speed drive as controlled by a variable speed drive circuit. Variable drive circuits for motor control are well known and essentially, an adjustable, varying speed motor is one where the speed can be adjusted. Variable speed motors are well known and, for example, motor control can be implemented by many different techniques. There are control circuits which control the speed of the motor which supply a variable width and variable frequency signal which, for example, has a duty cycle and a frequency dependent on the current directed through the motor. Such control devices are implemented using current feedback to sense motor speed. Such circuits can control the speed of the motor by varying the pulse width as well as pulse frequency. Speed control by frequency variation is referred as Variable Frequency Drive (VFD). The entire field of motor control is quite well known. Speed control can be implemented by the use of thyristors or SCR's and in certain situations is analogous to light dimming circuits.

As will be explained, when using a variable speed drive to drive the pump's motor 20, two measurements can be made in the drive without the need of any additional pump instruments. A variable speed or VFD device accurately enables one to calculate the motor speed and torque.

As shown in FIG. 1, there is a processor 25 which essentially may be included in the variable speed drive circuitry 21 and is responsive to motor rotation or torque. The function of the processor, as will be explained, is to solve or process the Affinity Laws governing the operation of centrifugal pumps to determine and measure the two variables at different motor speeds and to thereby process the variables according to well known relationships as derived from the Affinity Laws. These relationships will be described in the subsequent specification by means of actual mathematical formulas. It is understood that the processor 25 may contain a microprocessor which would further include a random access memory or other memory means having stored therein the various characteristics of a particular pump such as the hydraulic performance characteristics to thereby make measurements indicative of the operating point of the pump automatically by processing well known algorithms and according to the discussion as follows. The processor 25 can also control the variable speed drive to enable automatic operation during a test period at different speeds.

As also will be seen, if a variable speed drive 21 is not used to drive the motor, then a torque shaft can be used to measure both the torque and speed of the motor. A torque shaft could be coupled directly to the drive shaft or to the output shaft of the motor. If this approach is used, then the number of instruments required are reduced and one avoids the need of obtaining instrumentation to measure suction pressure, discharge pressure, pumpage temperature, flow and speed, while still having all the advantages of an accurate means of determining the operating point of the pump.

The example disclosed herein provides a method for determining the operating point of a centrifugal pump based on motor torque and motor speed. This method is premised on the theory that any two independent pump variables accurately measured will determine the operating point of a centrifugal pump. In this case, the two specific independent pump variables that are used are motor speed and motor torque. If a variable frequency drive (VFD) is used to drive the pump's motor the two measurements can be made in the drive without the need of any pump instruments. It wasn't until recently that VFD's could accurately calculate the actual motor speed and motor torque. If a VFD is not used, a single sensor (e.g., a torque shaft) can be used to measure both the motor torque and the motor speed. This approach reduces the number of instruments needed to determine the operating point of a centrifugal pump, and eliminates drawbacks of prior known methods.

The first step in practicing the method is to obtain the typical hydraulic performance curve for the subject pump. Speed, TDH, flow and pump efficiency data are obtained at both the minimum continuous flow and maximum flow for the impeller diameter in the pump, using techniques commonly known to those skilled in the art.

Once the foregoing information is obtained, the Brake Horsepower (BHP) of the pump is determined at each point using the following equation:

$$BHP = \frac{Q * TDH}{K_1 * n}$$

wherein the variables Q, TDH and n are defined as follows:

"Q" is flow in gallons per minute (gpm);

"TDH" is Total Dynamic Head in feet;

"n" is pump efficiency; and,

"$K_1$"=3960 a unit conversion constant.

The next step is to determine the torque (T) at each operating point using the following equation:

$$T = \frac{BHP * K_2}{N}$$

wherein the variables N and T are defined as follows:

"N" is the pump speed in revolutions per minute (rpm);

"T" is torque in foot-pounds; and,

"$K_2$"=5252 a unit conversion constant.

Using the pump Affinity Laws, the next step is to calculate the Torque and TDH of the pump at several different speeds for both the minimum and maximum flow points:

$$\frac{(N1)}{(N2)} = \frac{(Q1)}{(Q2)} \text{ and } \frac{(N1)\text{^}2}{(N2)\text{^}2} = \frac{(TDH1)}{(TDH2)}$$

where N1 is a first speed; N2 is a second speed; Q1 is the flow at the first speed; Q2 is the flow at the second speed; TDH1 is the total dynamic head at the first speed; and TDH2 is the total dynamic head at the second speed.

Essentially, the pump Affinity Laws are used in the design of testing centrifugal pumps and compressors to predict their performance when the speed of the unit is changed. The laws are:

1. The flow through unit is directly proportional to the speed;
2. The head developed is proportional to the speed squared;
3. The Brake Horsepower is proportional to the speed cubed; and,
4. The efficiency remains approximately constant.

A change in the tip diameter of the impeller will produce approximately the same changes in the performance as a change in speed. Therefore, the Affinity Laws may be used by substituting the outside diameter of the impeller for the rotational speed. The use of these laws is well known. The efficiency of the centrifugal pump is directly related to its specific speed and may achieve values of 90 percent or greater. It would be higher if the pump is handling large flows and low-pressure rises, and generally will be lower for small flows and high pressure.

Figure 2:
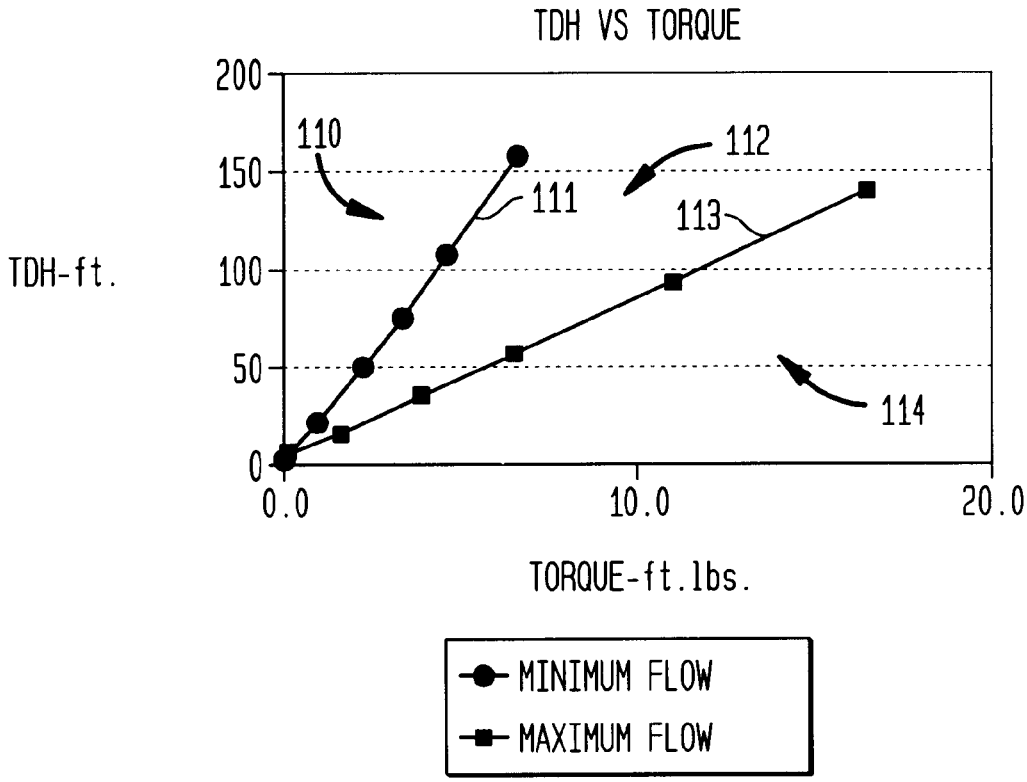
FIG. 2 shows a graph of Total Dynamic Head v. Torque for an exemplary centrifugal pump.

The two sets of data, namely, Torque and TDH data, are then plotted to obtain non-traditional hydraulic performance curves for the centrifugal pump. FIG. 2 shows the non-traditional hydraulic performance curves of an exemplary pump. Line 111 represents the Torque/TDH relationship at minimum flow. Line 113 represents the Torque/TDH relationship at maximum flow. The area 110 between the vertical axis and the first line 111 represents the low flow operational range. The area 114 between the horizontal axis and the second line 113 is the high flow operational range. The area 112 between the two lines 111, 113 is the normal flow operating range of the pump.

Without the use of any sensors attached directly to the pump, the method can detect low flow and high flow operation of the pump.

As mentioned above, any two independent pump variables can be used to determine the operating state of the pump. Torque and speed were chosen for the embodiment of the invention because no pump sensors would be required. As an example, if a pumping system already has a flow sensor and pump differential transducer, those two independent variables could be used to determine if the pump is operating below minimum flow, within the normal operating range or above the maximum flow operating range. For a given pump (model, size, diameter) and pumpage (temperature, specific gravity and viscosity) its independent variables are: Total Dynamic Head (TDH), Speed (N), Flow (Q) and either Brake Horsepower (BHP) or Torque (T).

It is assumed that the temperature of the pumpage does not vary sufficiently to cause significant percentage changes in the Specific Gravity of the fluid, and that the pump is in good operating condition and not in cavitation.

A number of advantages are achieved in accordance with the method described above. For example, this method can be used to identify when a pump is operating outside its acceptable hydraulic envelope. Specifically, the method can be used to determine when a pump is operating below minimum flow rate or above maximum flow rate at any speed. The method provides a way for determining whether the pump is operating within its normal flow operating range while eliminating the need for pump sensors employed using conventional methods. The invention also provides the foundation for the development of virtual pump sensors, and, therefore, is a major building block for the next generation of smart pumps.

Although the invention has been described in terms of exemplary embodiments, it is not limited thereto. Rather, the appended claims should be construed broadly, to include other variants and embodiments of the invention which may be made by those skilled in the art without departing from the scope and range of equivalents of the invention.

What is claimed is:

1. A method of determining the operating point of a centrifugal pump having a given hydraulic performance characteristic comprising the steps of:

measuring at least two independent variables capable of determining the operating point of the pump by, measuring the two independent variables at least at a first pump rotational speed;

measuring the two independent variables at least at a second different pump rotational speed; and processing the measured independent variables as measured at each speed to provide two sets of data indicative of the operating point of said pump, wherein the given hydraulic performance characteristic is obtained at both minimum and maximum continuous flow for a given impeller diameter of the centrifugal pump, and the flow (Q), total dynamic head (TDH) and pump efficiency (n) are used to compute the Brake Horsepower (BHP) by computing:

$$BHP = \frac{Q * TDH}{K_1 * n}$$

where Q is the flow in gpm,

TDH is the total dynamic head in feet, n is the pump efficiency, and, $K_1$ is a constant depending on the unit conversion.

2. The method according to claim 1 wherein the two independent variables are pump motor torque (T) and pump motor speed (N).

3. The method according to claim 2 wherein the pump motor torque is computed at a first pump motor speed $N_1$ and at a second pump motor speed $N_2$ by computing:

$$T = \frac{BHP * K_2}{N}$$

where T is the torque in foot pounds, and, $K_2$ is a constant depending on the unit conversion.

4. The method according to claim 3 wherein the step of processing includes computing:

$$\frac{(N_1)}{(N_2)} = \frac{(Q_1)}{(Q_2)} \quad \text{and} \quad \frac{(N_1)\text{^}2}{(N_2)\text{^}2} = \frac{TDH_1}{TDH_2}$$

where

N1 is the first pump motor speed;

N2 is the second pump motor speed;

Q1 is a flow at said first pump motor speed;

Q2 is a flow at said second pump motor speed;

TDH1 is a Total Dynamic Head at the first pump motor speed; and,

TDH2 is a Total Dynamic Head at the second pump motor speed.

5. Apparatus for determining the operating point of a centrifugal pump, comprising:

a centrifugal pump having a rotating impeller coupled to a drive shaft for pumping fluid by centrifugal force;

a motor coupled to the drive shaft operative to rotate the drive shaft and therefore the impeller at a selected rotational speed;

a variable speed drive circuit coupled to the motor and operative to vary the selected speed to operate the motor at any one of a plurality of selected speeds;

the motor producing different values for motor variables at each selected speed; and a processor responsive to each speed to process the selected motor values provided at each speed to provide an output indicative of the operational point of the motor by computing at least two variables at the different speeds using the pump Affinity Laws wherein the at least two variables are Motor Torque (T) and total dynamic head (TDH).

6. The apparatus according to claim 5 wherein the processor has stored therein Brake Horsepower (BHP) of the centrifugal pump.

7. The apparatus according to claim 6 wherein the processor operates to compute the Torque (T) and total dynamic head (TDH) by solving the following equations:

$$\frac{(N_1)}{(N_2)} = \frac{(Q_1)}{(Q_2)} \quad \text{and} \quad \frac{(N_1)\text{^}2}{(N_2)\text{^}2} = \frac{(TDH_1)}{(TDH_2)}$$

where $N_1$=a first pump motor speed;

$N_2$=a second pump motor speed;

$Q_1$=flow at said first pump motor speed;

$Q_2$=flow at said second pump motor speed;

$TDH_1$=total dynamic head at said first pump motor speed; and, $TDH_2$=total dynamic head at said second pump motor speed.

8. Apparatus for determining the operating point of a centrifugal pump, comprising:

a centrifugal pump having a rotating impeller coupled to a drive shaft for pumping fluid by centrifugal force;

a motor coupled to the drive shaft operative to rotate the drive shaft and therefore the impeller at a selected rotational speed;

a variable speed drive circuit coupled to the motor and operative to vary the selected speed to operate the motor at any one of a plurality of selected speeds;

the motor producing different values for motor variables at each selected speed; and a processor responsive to each speed to process the selected motor values provided at each speed to provide an output indicative of the operational point of the motor by computing at least two variables at the different speeds using the pump Affinity Laws, wherein the selected speeds are measured at minimum and maximum flow points.

9. A method for determining whether a centrifugal pump is operating within a normal flow operating range comprising the steps of:

determining the actual operating point of the centrifugal pump based on motor torque and motor speed; and comparing the actual operating point of the centrifugal pump to minimum and maximum flow operating ranges of the centrifugal pump to determine whether the centrifugal pump is operating within minimum flow and maximum flow operating ranges.

10. A method for determining whether a centrifugal pump is operating in a normal flow operating range comprising the steps of:

determining a hydraulic performance curve for a minimum continuous flow rate in order to obtain a minimum flow operating range for the centrifugal pump;

determining a hydraulic performance curve for a maximum flow rate in order to obtain a maximum flow operating range for the centrifugal pump;

computing a torque for the maximum operating range a torque for the minimum operating range;

computing the torque and TDH at different operating speeds; and determining the pump operating point by processing the computed values.

11. A method of determining the operating point of a centrifugal pump, the method comprising the steps of:

(a) obtaining from the centrifugal pump's hydraulic performance curve, a first total dynamic head, a flow and a pump efficiency, at minimum and maximum continuous flow for a first pump motor speed and a given impeller diameter of the centrifugal pump;

(b) determining, for each of the minimum and maximum continuous flow, a first pump motor torque at the first pump motor speed;

(c) determining, for each of the minimum and maximum continuous flow, at least a second pump motor torque and at least a second total dynamic head at least at a second pump motor speed;

(d) plotting, for each of the minimum and maximum continuous flow, the first and at least a second total dynamic head and the first and at least a second pump motor torque on a X-Y graph having an X-axis representing pump motor torque and a Y-axis representing total dynamic head, wherein first and second data plots are generated, the first data plot representing the minimum continuous flow and the second data plot representing the maximum continuous flow, an area defined by the Y-axis and the first data plot is a low-flow operating area, an area defined by the X-axis and the second data plot is a high-flow operating area, and an area defined between the two data plots is a normal-flow operating range; and (e) determining an actual operating point of the centrifugal pump in relation to the first and second data plots based on a measured pump motor torque and a measured pump motor speed.

12. The method according to claim 11 wherein the actual operating point is determined according to maximum and minimum flow at any pump motor speed.

13. The method of claim 11, wherein the step of determining an actual operating point of the centrifugal pump comprising:

obtaining the measured pump motor torque and measured pump motor speed of the centrifugal pump from a variable speed drive of the centrifugal pump while the pump is operating; and determining the actual operating point of the centrifugal pump by locating a point on the X-Y graph which represents the measured pump motor speed and the measured pump motor torque, to determine whether the centrifugal pump is operating in the low-flow operating area, high-flow operating area, or the normal-flow operating range.

14. The method of claim 11, wherein the step of determining, for each of the minimum and maximum continuous flow, a first pump motor torque at the first pump motor speed comprising:

computing Brake Horsepower by computing:

$$BHP = \frac{Q * TDH}{K_1 * n}$$

where Q is the flow in gpm,

TDH is the total dynamic head in feet, n is the pump efficiency,and $K_1$ is a constant depending on the unit conversion; and computing pump motor torque at the first pump motor speed by computing:

$$T = \frac{BHP * K_2}{N}$$

where T is the torque in foot pounds, $K_2$ is a constant depending on the unit conversion, and N is the first pump motor speed.

15. The method according to claim 11, wherein the step of determining, for each of the minimum and maximum continuous flow, at least a second pump motor torque and at least a second total dynamic head at least at a second pump motor speed comprising:

solving the following equations:

$$\frac{(N_1)}{(N_2)} = \frac{(Q_1)}{(Q_2)} \quad \text{and} \quad \frac{(N_1)\text{^}2}{(N_2)\text{^}2} = \frac{(TDH_1)}{(TDH_2)}$$

where $N_1$=the first pump motor speed, $N_2$=the second pump motor speed, $Q_1$=flow at the first pump motor speed, $Q_2$=flow at the second pump motor speed, $TDH_1$=total dynamic head at the first pump motor speed, and $TDH_2$=total dynamic head at the second pump motor speed.

16. A pump apparatus comprising:

a centrifugal pump having an impeller and a motor which drives the impeller at a selected pump speed;

a variable speed drive circuit for varying the selected pump speed at which the motor drives the impeller;

a processor;

a memory associated with the processor, the memory storing normal-flow operating range of the centrifugal pump generated by:

obtaining from the centrifugal pump's hydraulic performance curve, a first total dynamic head, a flow and a pump efficiency, at minimum and maximum continuous flow for a first pump motor speed and a given impeller diameter of the centrifugal pump;

determining, for each of the minimum and maximum continuous flow, a first pump motor torque at the first pump motor speed;

determining, for each of the minimum and maximum continuous flow, at least a second pump motor torque and at least a second total dynamic head at least at a second pump motor speed;

plotting, for each of the minimum and maximum continuous flow, the first and at least a second total dynamic head and the first and at least a second pump motor torque on a X-Y graph having an X-axis representing pump motor torque and a Y-axis representing total dynamic head, wherein two data plots are generated, first data plot representing the minimum continuous flow and second data plot representing the maximum continuous flow, the first and second data plots defining the normal-flow operating range of the centrifugal pump; and wherein the processor compares the actual operating point of the centrifugal pump based on a measured pump motor torque and a measured pump motor speed to the normal-flow operating range of the centrifugal pump stored in the memory to determine if the actual operating point of the centrifugal pump is within the normal flow operating range.

17. The apparatus according to claim 16 wherein the pump further includes a flow sensor and a pump differential transducer.

* * * * *